US005770546A

United States Patent [19]

Grothe et al.

[11] Patent Number: 5,770,546

[45] Date of Patent: Jun. 23, 1998

[54] SUPERCONDUCTOR BANDPASS FILTER HAVING PARAMETERS CHANGED BY A VARIABLE MAGNETIC PENETRATION DEPTH

[75] Inventors: Wolfgang Grothe, Tiefenbronn; Klaus Voigtlaender, Wangen; Matthias Klauda, Erlangen; Claus Schmidt, Magstadt, all of Germany

[73] Assignee: Robert Bosch GmbH, Stuttgart, Germany

[21] Appl. No.: 551,654

[22] Filed: Nov. 1, 1995

[30] Foreign Application Priority Data

Nov. 22, 1994 [DE] Germany ..... 44 41 488.9

[51] Int. Cl.[6] ..... H01P 1/203; H01B 12/02

[52] U.S. Cl. ..... 505/210; 505/701; 505/866; 333/99 S; 333/205

[58] Field of Search ..... 333/99 S, 204, 333/205, 219; 505/210, 700, 701, 866

[56] References Cited

U.S. PATENT DOCUMENTS 3,857,114 12/1974 Minet ..... 333/205

FOREIGN PATENT DOCUMENTS 190001 7/1989 Japan ..... 333/204

101801 4/1990 Japan ..... 333/204

6216606 8/1994 Japan ..... 333/204

OTHER PUBLICATIONS

Tinkham, M./"Introduction to Superconductivity"/1975/pp. 79–81/Robert Krieger Pub.

Bartlogg, B./Physical Properties . . . /Physics Today, pp. 44–50, Jun. 1991.

Trotel, A. etla./Appl. Phys. Let./Apr. 29, 1996/pp. 2559–2561.

*Primary Examiner*—Benny T. Lee
*Attorney, Agent, or Firm*—Michael J. Striker

[57] ABSTRACT

The superconductor bandpass filter for electromagnetic signals includes a substrate (5); striplines (1) made of a type II superconductive material arranged on the substrate and a tuning device (2) for tuning the superconductor bandpass filter consisting of a device for changing a magnetic penetration depth λ(T) of the striplines (1), so as to change the effective length, effective width and effective spacing of the striplines and thus to change the center frequency and/or the bandwidth. The device for changing the magnetic penetration depth λ(T) of the striplines (1) advantageously includes a device for exerting a mechanical force or stress on the striplines and/or a device for varying a magnetic field applied to the striplines.

10 Claims, 2 Drawing Sheets

SUPERCONDUCTOR BANDPASS FILTER HAVING PARAMETERS CHANGED BY A VARIABLE MAGNETIC PENETRATION DEPTH

BACKGROUND OF THE INVENTION

The present invention relates to a superconductor bandpass filter. Superconductor bandpass filters are known in which a plurality of striplines deposited one beside the other on a substrate are used to allow radio-frequency signals to pass only in a specific frequency range. The frequency range is in this case defined by the geometrical arrangement of the striplines on the substrate.

SUMMARY OF THE INVENTION

It is an object of the present invention to provide an improved tunable superconductor bandpass filter of the above-described type.

According to the invention, the tunable superconductor bandpass filter for electromagnetic signals has a bandwidth for the electromagnetic signals with a center frequency and comprises a substrate; a plurality of striplines composed of a superconductive material, advantageously a Type II superconductive material, deposited on the substrate and means for tuning the superconductor bandpass filter consisting of means for changing a magnetic penetration depth $\lambda(T)$ of the striplines, so as to change the effective length, effective width and effective spacing of the striplines and thus to change the center frequency and/or the bandwidth.

The superconductor bandpass filter according to the invention has, in contrast, the advantage that despite a geometrically fixed arrangement of the striplines on the substrate a variable pass characteristic of the superconductor bandpass filter can be achieved.

In some embodiments of the invention the means for tuning includes means for exerting a mechanical force or stress on the striplines, which advantageously comprises one or more press elements each having a round contact-pressure head and a device for pressing the press element or elements against the substrate and/or the striplines.

In other embodiments the means for tuning the filter includes means for applying a magnetic field to the striplines on the substrate as well as means for varying the field strength and/or field direction of the applied magnetic field.

It is particularly advantageous to design the tuning device in such a manner that a mechanical force or stress can be exerted on the striplines, since in this way a very cost-effective tuning device can be realized.

As a result of the fact that the tuning device has at least one pressure element which can be pressed against the surface of the substrate or of the striplines, reliable and at the same time efficient tuning of the superconductor bandpass filter can be achieved.

It has furthermore proved advantageous if a further pressure element is provided which is arranged opposite the first pressure element, since in this way tuning of the superconductor bandpass filter is possible in two different directions.

When a pressure element has a rounded contact-pressure head, the production of local stresses on the substrate or on the striplines is avoided in an advantageous manner, as a result of which the risk of damage to the superconductor bandpass filter by the pressure elements is reduced.

The use of a flexible substrate increases the tunability of the superconductor bandpass filter in an advantageous manner, since by virtue of the flexibility greater mechanical deformation and consequently a larger tuning range can be realized.

It is moreover possible to tune the superconductor bandpass filter in terms of its center frequency or its bandwidth by means of a magnetic field. The use of magnetic fields permits particularly precise tuning of the superconductor bandpass filter. In addition, no mechanical forces act on the substrate or striplines, thus further reducing the risk of damage.

The variation in field strength and/or field direction of the magnetic field is accompanied by the advantage that it is possible to exert an influence on the pass characteristic of the superconductor bandpass filter in very different ways.

If the field strength range in which the magnetic field is variable is selected as a function of the field direction relative to the surface of the striplines, various physical effects can be used for tuning the superconductor bandpass filter.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE EXEMPLARY EMBODIMENTS

Figure 1:
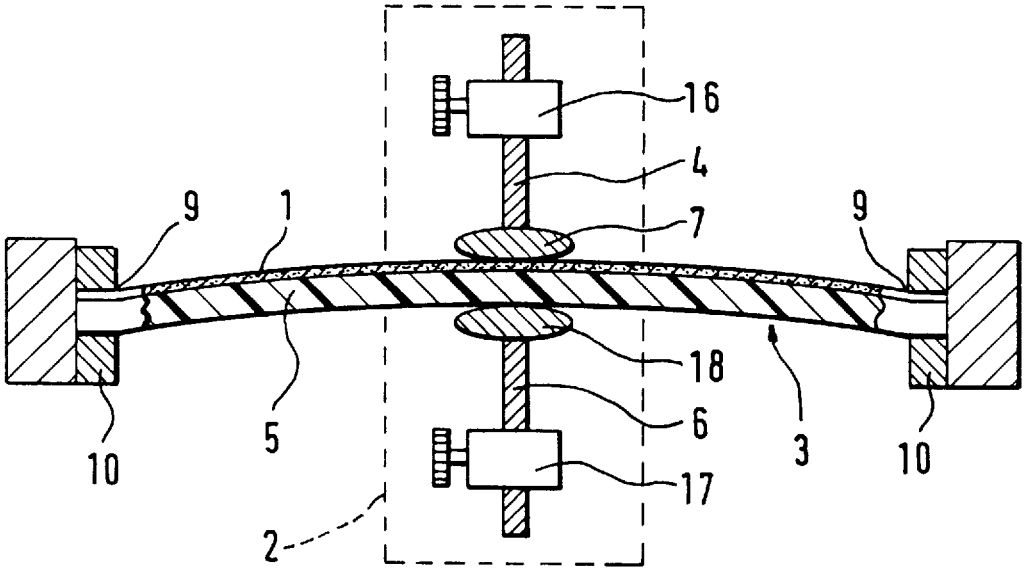
FIG. 1 is a schematic cross-sectional view through one embodiment of a tunable superconductor bandpass filter according to the invention.

FIG. 1 illustrates a flat substrate 5 whose top side is partially coated with striplines 1 made from a superconductive material. Two of the striplines 1 are connected in each case on one side to contacts 9 which are fastened to mountings 10 into which the substrate 5 is clamped together with the striplines 1. The substrate 5 forms together with the striplines 1 a superconductor bandpass filter 3 for filtering radio-frequency signals which are passed to and from the filter via the contacts 9. A mechanical adjusting device 16 serves to displace a pressure element 4 having a contact-pressure head 7 attached to one end. The contact-press head 7 is in contact with the superconductor bandpass filter 3 on the surface of the striplines 1. A further mechanical adjusting device 17 drives a further press element 6 which has a further contact-pressure head 18 at its end. The further contact-pressure head 18 is in contact with the substrate 5 on the side opposite the first contact-pressure head 7. The adjusting devices 16, 17 as well as the press elements 4, 6 form together with the contact-pressure heads 7, 18 a tuning device 2. The superconductive material is a type-II superconductor, i.e. it has two critical field strengths which separate the three conductive states of the superconductor, that is Meissner phase, mixed phase and non-superconductive phase from one other.

The press elements 6, 4 can be displaced perpendicularly relative to the surface of the superconductor bandpass filter 3 by means of the adjusting devices 16, 17. In this process, the superconductor bandpass filter 3, which is clamped in at its ends, is deformed in that it is deflected at its center relative to the border regions, which are clamped into the mountings 10. The bending of the superconductor bandpass filter 3 results, on the one hand, in a change in the linear dimensions of the striplines 1. Such a change also concerns the length of the striplines 1, which has a direct influence on the center frequency of the superconductor bandpass filter 3. The mechanical bending of the substrate 5 and of the striplines 1 results, on the other hand, in a mechanical stress in the striplines 1. The superconducting striplines l, which are made of type II superconducting material as indicated above and which contain Cu-o layers, are usually fitted on the substrate 5 in such a manner that their Cu—O layers are oriented parallel to the surface of the substrate 5. These Cu—O layers are extremely sensitive to strains, changing the transition temperature $T_c$of the superconducting material. The magnetic penetration depth $\lambda(T)$ of superconducting materials is a function of the transition temperature $T_c$:$\lambda(T)\approx\lambda(T=OK)/\sqrt{(1-(T/T_c)^4)}$. The magnetic penetration depth $\lambda(T)$ is changed by the change in the transition temperature $T_c$as a result of the exertion of mechanical stress. The change in the magnetic penetration depth $\lambda(T)$ causes the effective dimensions, which are effective for the radio-frequency signals which are to be allowed to pass, of the striplines 1 to change in that the radio-frequency magnetic fields of the radio-frequency signals can penetrate into the striplines 1 at different depths, as a result of which the center frequency and/or the bandwidth of the superconductor bandpass filter 3 is shifted, depending on the direction of the mechanical forces of the tuning device 2. The preferred bending direction for influencing the filter properties of the superconductor bandpass filter 3 can be set by selecting the locations for attaching the mountings 10 or also by the alignment of the striplines 1. In addition, provision is likewise made for a plurality of such tuning devices 2 to be arranged one beside the other in order to achieve finer adjustability.

The contact-pressure heads 7, 18 are advantage_ ously designed to be elliptic or round, so that no local stresses which could cause formation of cracks are introduced into the superconductor bandpass filter 3. A material of sufficient flexibility, such as for example ceramic or a plastic film, is advantageously suitable for the substrate 5. As a result of the tuning device 2, it is possible in particular to trim the center frequency and/or the bandwidth of the superconductor bandpass filter 3 after the structuring of the striplines 1 has been carried out. This permits shifts in frequency which have been caused by inaccuracies during the structuring of the striplines 1 or during the planning of the structure of the striplines 1 to be compensated. It is also possible to couple the two mechanical adjusting devices 16, 17 in terms of their drive, for example in order to avoid an unwanted opposite-sense pressure on the substrate 5.

Figure 2:
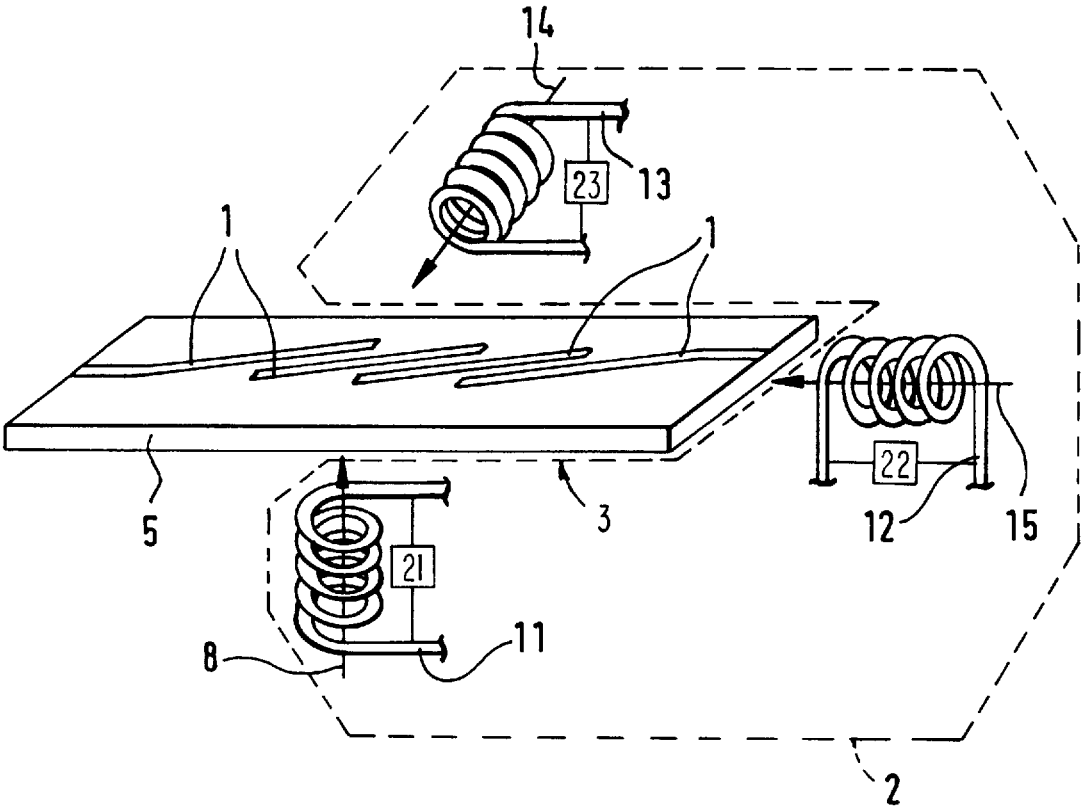
FIG. 2 is a diagrammatic perspective view through another embodiment of a tunable superconductor bandpass filter according to the invention.
Figure 3:
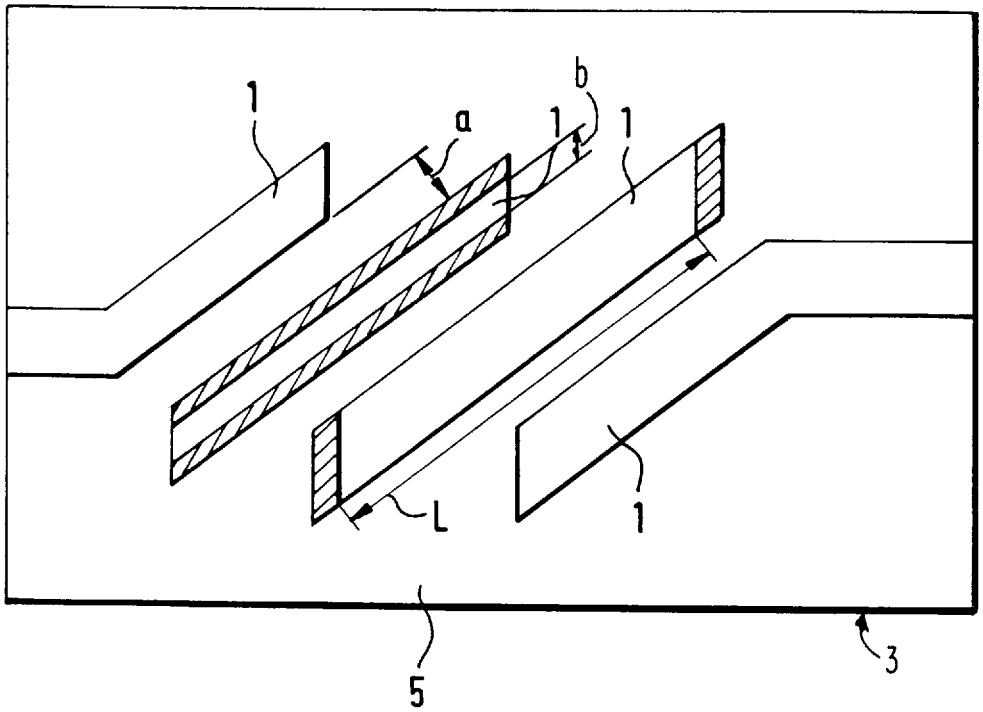
FIG. 3 is a top plan view of a portion of the surface of a superconductor bandpass filter according to the invention.

FIG. 2 illustrates a further exemplary embodiment for a tunable superconductor bandpass filter 3 according to the invention. For more detailed explanation, reference is also made to FIG. 3. In this case, identical parts were designated with identical numerals as in FIG. 1. Arranged around the substrate 5, with the striplines 1 deposited thereon, are three coils 11, 12, 13. The three coils 11, 12, 13 (FIG. 2) have in each case one magnetic field direction axis, the three magnetic field direction axes being oriented orthogonally relative to each other. Each magnetic field direction axis represents the field direction for a magnetic field component 8, 14, 15 as shown in FIG. 2. As a result, a magnetic field 20 can be produced which is composed of the three magnetic field components 8, 14, 15 of the coils 11, 12, 13 and which can assume any direction. FIG. 3 illustrates the surface of the substrate 5 with the striplines 1. The striplines 1 have an effective width b, an effective length L and an effective spacing a from one another (the difference between the effective length L and the actual length of the stripline and between the effective width b and the actual width is illustrated in FIG. 3 by the shaded or cross-hatched portions of the striplines as well as by drawing in the effective length L and effective width. These geometrical dimensions as well as the thickness and the relative permittivity of the substrate 5 define the pass range of the superconductor bandpass filter 3.

As a result of the layer structure of superconductive materials, the striplines 1 have a strong anisotropy of the magnetic penetration depth $\lambda(T)$. The magnitude of the magnetic penetration depth $\lambda(T)$ can therefore be varied by varying the field direction of the magnetic field 20. The magnetic field 20 has added to it the radio-frequency magnetic field of the radio-frequency signals. It has then to be distinguished between two basic physical mechanisms which permit different adjustability for the effective filter dimensions. For delimiting the two physical mechanisms, the demagnetization factor n of the striplines 1 is important, this depending to a large degree on the geometry of the striplines 1. The coil 11 is arranged in such a manner that the magnetic field component 8 produced by it is oriented approximately perpendicular relative to the plane of the striplines 1 as shown in FIG. 2. The thickness of the stripline 1 is usually very small when compared to its width and even smaller when compared to its length. The demagnetization factor n for the magnetic field component 8 is therefore relatively high owing to the great difference between width and thickness of the striplines 1. A high demagnetization factor n results in a small so-called effective lower critical field strength $H_{cl,eff}^{c}(T)$ . In accordance with the high demagnetization factor n for the magnetic field component 8 arranged perpendicular to the plane of the striplines 1, the striplines 1 have, in their border region, in this magnetic field 20 produced by the single magnetic field component 8, a higher field concentration than in the center of their surface. The highest field strength therefore always occurs at the border of the striplines 1.

For the magnetic field component 8, which is effective in the direction orthogonal to the stripline surface as shown in FIG. 2, a first type of adjustment of the center frequency of the superconductor bandpass filter 3 is possible by variation of the field strength range of the magnetic field component 8 below the critical field strength $H_{cl,eff}^{c}(T)$ determined by the demagnetization factor n. This adjustment can be tuned relatively finely. By adding the magnetic field component 8 to the magnetic field of the radio-frequency signals, the effective lower critical field strength $H_{cl,eff}^{c}(T)$ is exceeded directly at the border region of the striplines 1. As a result, the striplines 1 come into the so-called mixed state within a thin layer thickness which is smaller than the magnetic penetration depth $\lambda(T)$, and the effective width b and length L of the striplines 1 are reduced by this layer thickness, i.e. the current of the radio-frequency signals then flows predominantly in the layer which is in the mixed state, while the magnetic field 20 and the radio-frequency magnetic field continue to penetrate into the striplines 1 approximately only up to the magnetic penetration depth $\lambda(T)$.

If a field strength is produced which already exceeds the critical field strength $H_{cl,eff}^{c}(T)$ in the border region of the striplines 1, the superconducting material of the striplines 1 passes in a markedly greater layer thickness into the mixed state in which, as a result of the higher field concentration at the borders of the striplines 1, increased penetration of radio-frequency magnetic fields is made possible there far beyond the extent of the magnetic penetration depth $\lambda(T)$. In contrast, the field strength in the central region of the striplines 1 still remains below the critical field strength $H_{cl,eff}^{c}(T)$. Since the penetration depth which is present in the mixed state in the border region of the striplines 1 is considerably higher than the magnetic penetration depth $\lambda(T)$, an even stronger constriction of the effective width b or length of the striplines 1 can be produced here. A second type of adjustment of the effective dimensions of the striplines 1 is therefore possible when the critical field strength $H_{cl,eff}^{c}(T)$ is exceeded.

For the magnetic field components 14, 15 in the plane of the stripline surface as shown in FIG. 2, the geometry factor of the striplines 1 differs substantially from the geometry factor for the magnetic field component 8 perpendicular thereto. This then also results in a reduced demagnetization factor n and an increased critical field strength $H_{cl,eff}^{c}(T)$. For the magnetic field components 14, 15, which lie in the plane of the surface of the striplines 1 the critical field strength $H_{cl,eff}^{c}(T)$ is thus only of secondary importance since on account of the demagnetization factor $n \approx 1$ which is present here the mixed state only occurs in the case of much stronger magnetic fields. For this reason, these two magnetic field components 14, 15 can be used for setting the filter properties only via the first type of adjustment, i.e. below the critical field strength $H_{cl,eff}^{c}(T)$ . The choice of field strength is therefore decisive for the respectively effective mechanism, on account of the geometrical relationships of the striplines 1 the field strength to be chosen also being dependent on the field direction relative to the surface of the striplines 1.

By varying the individual magnetic field components 8, 14, 15, the orientation direction and the field strength of the magnetic field can thereby be changed and consequently the effective dimensions of the striplines 1 can be changed for the radio-frequency magnetic fields and currents of the radio-frequency signals. A change in the radio-frequency-effective length 1 of the striplines 1 changes the center frequency of the superconductor bandpass filter 3. In addition, a change in the effective spacing a of the striplines 1 from one other and thereby a variation in the bandwidth of the superconductor bandpass filter 3 can be effected by a variation in the effective width b of the striplines 1 by means of a correspondingly oriented magnetic field. The entire phase diagram of a type-II superconductor (Meissner phase and mixed state) can therefore be used by varying the direction and strength of the magnetic field.

Provision is likewise made to arrange the magnetic and the mechanical tuning device in an advantageous manner on a joint superconductor bandpass filter 3 and thereby to combine the two mechanisms. The filter according to the invention is not limited to the pattern of the striplines 1 illustrated in the drawing but can be used with any arrangements and embodiments of striplines 1. By means of an arrangement of a plurality of mechanical tuning devices, multiple tuning, which is carried out by locally distributed, different mechanical bending forces on the substrate 5, can be performed just for one superconductor bandpass filter 3 and also for a plurality of superconductor bandpass filters 3 arranged on a joint substrate 5. A preferred area of application for the superconductor bandpass filter 3 according to the invention is the filtering of radio-frequency signals in satellite communications or in mobile radio technology.

Device 21, 22 and 23 for varying the magnetic field strength, field strength range and/or direction are connected to the respective coils 11, 12, 13. Such devices are notoriously well known in the art.

While the invention has been illustrated and described as embodied in a superconductor bandpass filter, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A superconductor bandpass filter for electromagnetic signals, said superconductor bandpass filter having a bandwidth for said electromagnetic signals and a center frequency and comprising a substrate (5); a plurality of striplines (1) consisting of type II superconductive material arranged on said substrate and means (2) for tuning the superconductor bandpass filter consisting of means for changing a magnetic penetration depth ($\lambda(T)$) of the striplines, so as to change an effective length (L), an effective width (b) and an effective spacing (a) of the striplines and which in turn effects a change in at least one of said center frequency and said bandwidth, wherein said means for changing a magnetic penetration depth ($\lambda(T)$) of the striplines includes means for exerting a mechanical force or stress on the striplines (1).

2. The superconductor bandpass filter as claimed in claim 1, wherein said means for exerting a mechanical force or stress includes a press element (4) and means (16) for pressing said press element (4) against at least one of said substrate (5) and said striplines (1).

3. The superconductor bandpass filter as claimed in claim 2, wherein said press element (4) has a rounded contact-pressure head (7).

4. The superconductor bandpass filter as claimed in claim 2, wherein said means for exerting a mechanical force or stress includes at least one additional press element (6) and means (17) for pressing said at least one additional press element against at least one of said substrate (5) and said striplines (1).

5. The superconductor bandpass filter as claimed in claim 4, wherein said at least one additional press element (6) has a rounded contact-pressure head (7).

6. The superconductor bandpass filter as claimed in claim 1, wherein said substrate (5) is flexible.

7. A superconductor bandpass filter for electromagnetic signals, said superconductor bandpass filter having a bandwidth for said electromagnetic signals and a center frequency and comprising a substrate (5); a plurality of striplines (1) consisting of type II superconductive material arranged on said substrate and means (2) for tuning the superconductor bandpass filter consisting of means for changing a magnetic penetration depth ($\lambda(T)$) of the striplines, so as to change an effective length (L), an effective width (b) and an effective spacing (a) of the striplines and which in turn effects a change in at least one of said center frequency and said bandwidth, wherein said means for changing a magnetic penetration depth includes means (11,12,13) for applying a magnetic field to the striplines (1) on the substrate (5).

8. The superconductor bandpass filter as claimed in claim 7, wherein said means for applying a magnetic field to the striplines (1) comprises means (21,22,23) for varying at least one of a field strength and a field direction of said magnetic field.

9. The superconductor bandpass filter as claimed in claim 8, further comprising means for selecting a field strength range in which said field strength of said magnetic field is varied according to an orientation of said field direction relative to a surface of said striplines (1).

10. A superconductor bandpass filter for electromagnetic signals, said superconductor bandpass filter having a bandwidth for said electromagnetic signals and a center frequency and comprising a substrate (5), a plurality of striplines (1) consisting of a type II superconductive material arranged on said substrate and means (2) for tuning the superconductor bandpass filter consisting of means for changing a magnetic penetration depth ($\lambda(T)$) of the striplines, so as to change an effective length (L), an effective width (b) and an effective spacing (a) of the striplines and which in turn effects a change at least one of said center frequency and said bandwidth.

* * * * *